US005898279A

United States Patent [19]

Ezzedine et al.

[11] Patent Number: 5,898,279

[45] Date of Patent: Apr. 27, 1999

[54] CYCLOTRON MONITORING SYSTEM AND METHOD

[75] Inventors: Bilal Ezzedine, Centerville; Martin R. Satter, Springboro; Steven B. Binder, Dayton; Dah-Ren Hwang, Spring Valley; Joseph C. Mantil, Centerville, all of Ohio

[73] Assignee: Kettering Medical Center, Kettering, Ohio

[21] Appl. No.: 08/780,746

[22] Filed: Jan. 8, 1997

[51] Int. Cl.[6] ..... H05H 13/00

[52] U.S. Cl. ..... 315/502; 250/398; 376/190

[58] Field of Search ..... 315/502; 250/397, 250/398; 376/157, 194, 190

[56] References Cited

U.S. PATENT DOCUMENTS

| | | | |
|---|---|---|---|
| 3,675,072 | 7/1972 | Hahn et al. | 376/190 |
| 4,861,991 | 8/1989 | Michener | 250/310 |
| 5,017,789 | 5/1991 | Young et al. | 250/397 |
| 5,038,111 | 8/1991 | Lo | 328/233 |
| 5,280,505 | 1/1994 | Hughey et al. | 376/194 |
| 5,332,468 | 7/1994 | Englehardt | 156/643 |
| 5,655,138 | 8/1997 | Kikinis | 395/808 |

OTHER PUBLICATIONS

"Radioisotope Delivery System", brochure by Siemens Gammasonics, Inc., Hoffman Estates, Illinois, undated.

*Primary Examiner*—Sandra O'Shea
*Assistant Examiner*—Michael Day
*Attorney, Agent, or Firm*—Jacox, Meckstroth & Jenkins

[57] ABSTRACT

A system and method for monitoring cyclotron operation includes a sensing and monitoring system having vacuum sensor for sensing whether an acceleration chamber associated with the cyclotron is evacuated, a target sensor for sensing various target conditions which would indicate a faulty target condition, and a synthesis sensor for sensing whether the synthesis of the positron-emitting radio chemical is proceeding as desired. The system and method also includes an alarm feature for alarming or otherwise notifying a radio chemist or technician that one or more of the aforementioned cyclotron failures has occurred before the failure damages equipment or otherwise causes a significant delay or cancellation in the production of the radio chemical which is subsequently injected into a patient during a positron-emitting tomography procedure. The system and method senses the various fault conditions and generating one or more user-friendly display and subsequent alarm in response thereto.

63 Claims, 9 Drawing Sheets

CYCLOTRON
ION SOURCE
ACCELERATOR
28
30
12
11
SUPPLY FLUID
26
VACUUM
1
2
3
4
18a
18
20a
20
22a
22
24a
24
RADIO ISOTOPE
56
VACUUM PUMP
32
38
40
NEUTRON DETECTOR
SYNTHESIS MODULE
1 2 3 4
56a
56b
56c
56d
VACUUM SENSOR
34
PHOTO DIODE
62
RADIO CHEMICAL
36
DATA AQUISITION
14
COMPUTER
STORAGE
60
17
DISPLAY
ALARM
19

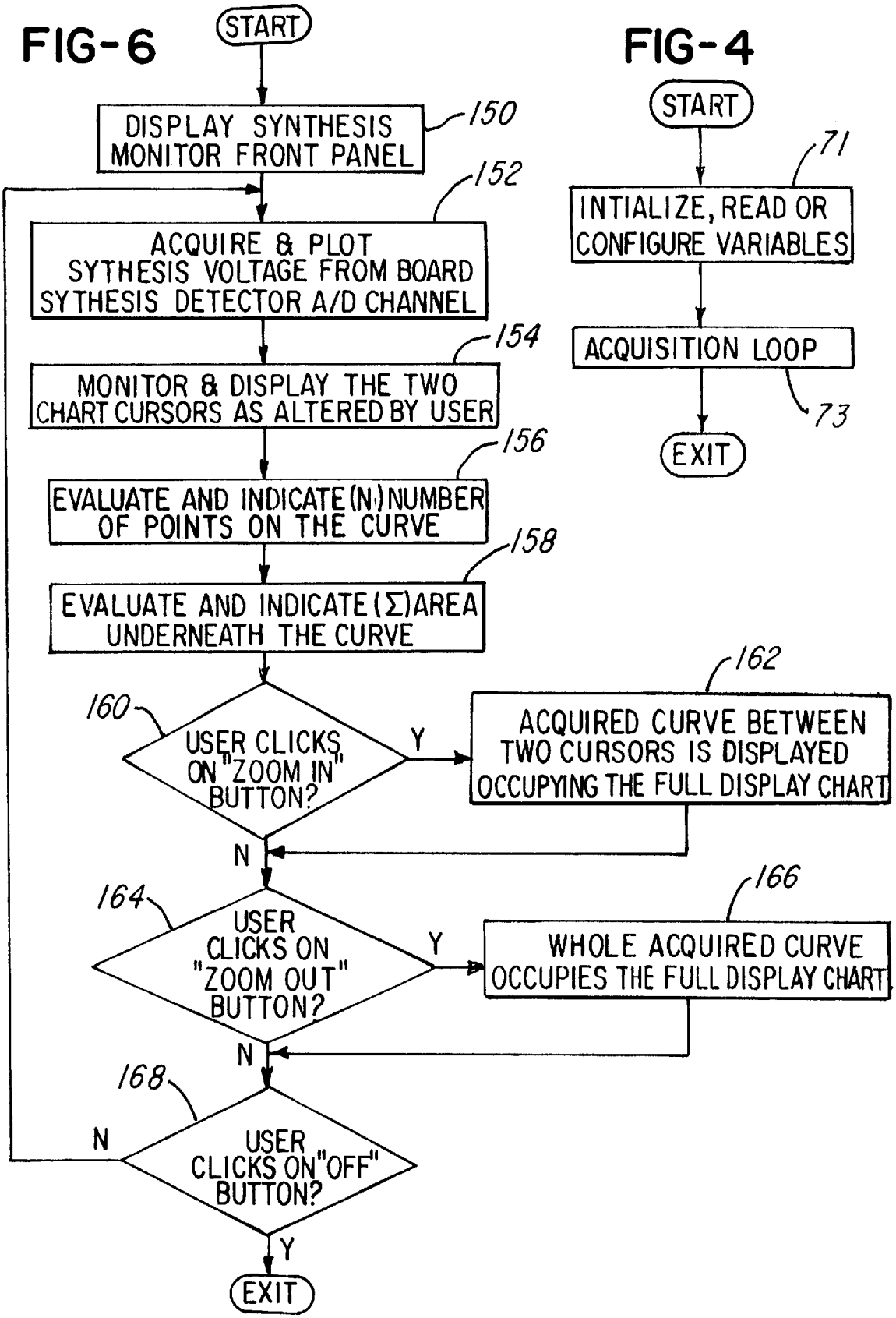
FIG-6
START
DISPLAY SYNTHESIS MONITOR FRONT PANEL
150
152
ACQUIRE & PLOT SYTHESIS VOLTAGE FROM BOARD SYTHESIS DETECTOR A/D CHANNEL
154
MONITOR & DISPLAY THE TWO CHART CURSORS AS ALTERED BY USER
156
EVALUATE AND INDICATE (N) NUMBER OF POINTS ON THE CURVE
158
EVALUATE AND INDICATE (Σ) AREA UNDERNEATH THE CURVE
160
USER CLICKS ON "ZOOM IN" BUTTON?
Y
162
ACQUIRED CURVE BETWEEN TWO CURSORS IS DISPLAYED OCCUPYING THE FULL DISPLAY CHART
N
164
USER CLICKS ON "ZOOM OUT" BUTTON?
Y
166
WHOLE ACQUIRED CURVE OCCUPIES THE FULL DISPLAY CHART
N
168
N
USER CLICKS ON "OFF" BUTTON?
Y
EXIT
FIG-4
START
71
INTIALIZE, READ OR CONFIGURE VARIABLES
ACQUISITION LOOP
73
EXIT

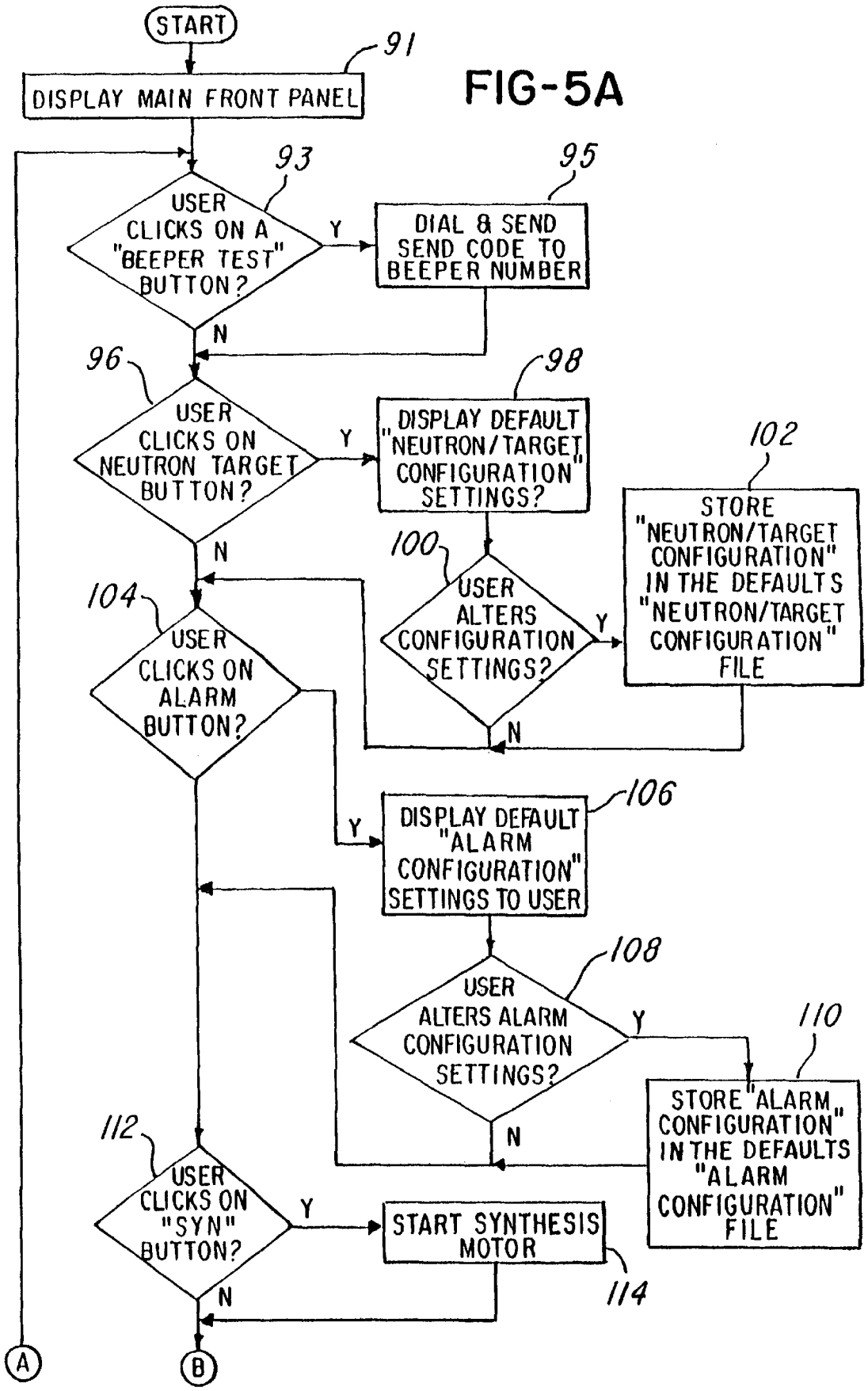
START
91
DISPLAY MAIN FRONT PANEL
FIG-5A
93
USER CLICKS ON A "BEEPER TEST" BUTTON?
Y
95
DIAL & SEND SEND CODE TO BEEPER NUMBER
N
96
USER CLICKS ON NEUTRON TARGET BUTTON?
Y
98
DISPLAY DEFAULT "NEUTRON/TARGET CONFIGURATION" SETTINGS?
102
STORE "NEUTRON/TARGET CONFIGURATION" IN THE DEFAULTS "NEUTRON/TARGET CONFIGURATION" FILE
N
100
USER ALTERS CONFIGURATION SETTINGS?
Y
N
104
USER CLICKS ON ALARM BUTTON?
Y
106
DISPLAY DEFAULT "ALARM CONFIGURATION" SETTINGS TO USER
108
USER ALTERS ALARM CONFIGURATION SETTINGS?
Y
110
STORE "ALARM CONFIGURATION" IN THE DEFAULTS "ALARM CONFIGURATION" FILE
N
112
USER CLICKS ON "SYN" BUTTON?
Y
START SYNTHESIS MOTOR
114
N
A
B

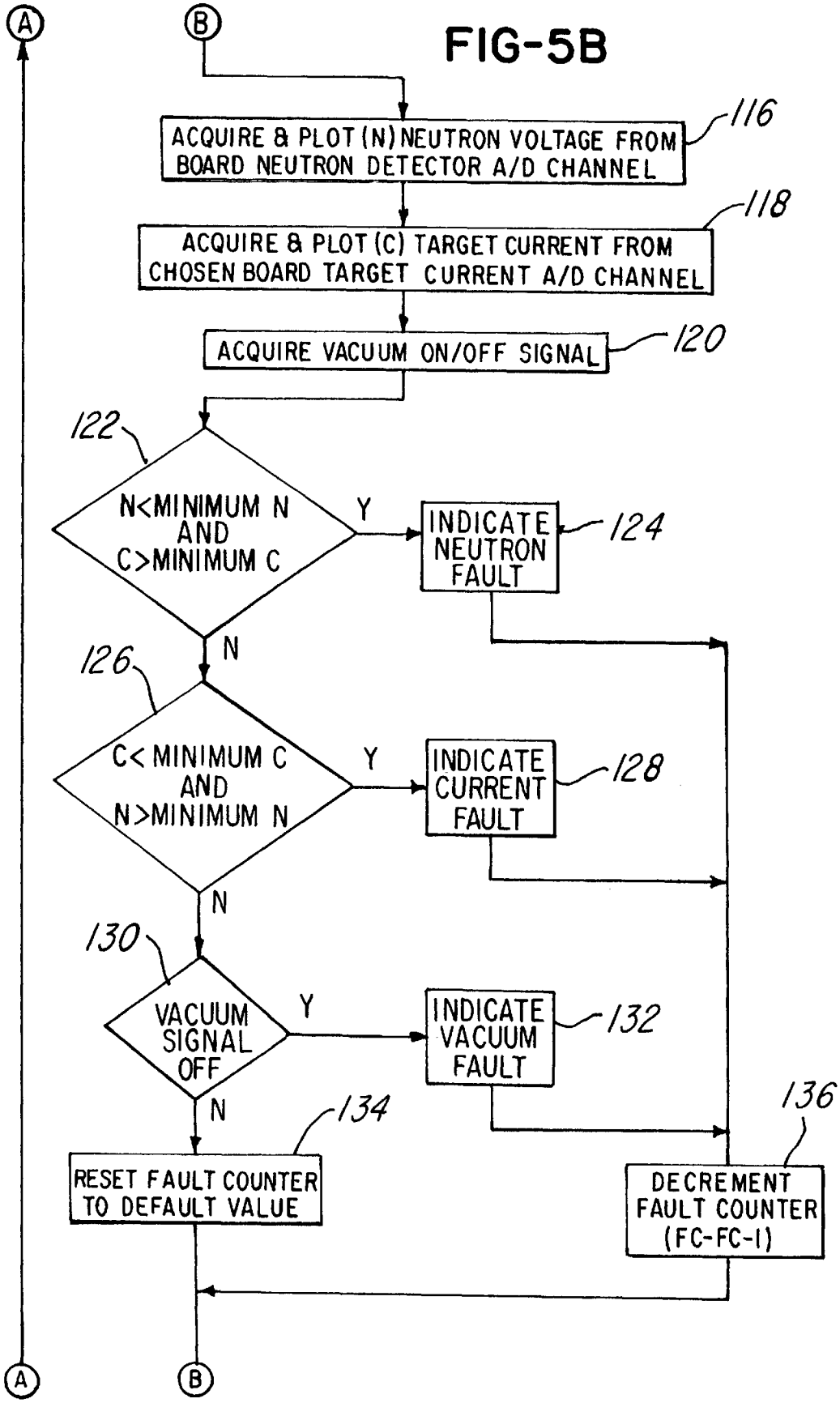
FIG-5B
A
B
ACQUIRE & PLOT (N) NEUTRON VOLTAGE FROM BOARD NEUTRON DETECTOR A/D CHANNEL
116
ACQUIRE & PLOT (C) TARGET CURRENT FROM CHOSEN BOARD TARGET CURRENT A/D CHANNEL
118
ACQUIRE VACUUM ON/OFF SIGNAL
120
122
N<MINIMUM N AND C>MINIMUM C
Y
INDICATE NEUTRON FAULT
124
N
126
C< MINIMUM C AND N>MINIMUM N
Y
INDICATE CURRENT FAULT
128
N
130
VACUUM SIGNAL OFF
Y
INDICATE VACUUM FAULT
132
N
134
RESET FAULT COUNTER TO DEFAULT VALUE
136
DECREMENT FAULT COUNTER (FC-FC-1)
A
B A
B
GENERATE DISPLAYS
138
USER CLICKS ON "OFF" BUTTON?
140
Y
EXIT
N
FAULT COUNTER FC<0?
142
N
Y
DIAL & SEND FAULT CODE TO BEEPERS
144
USER CLICKS ON "RESET" BUTTON?
146
Y
N

CYCLOTRON MONITORING SYSTEM AND METHOD

BACKGROUND OF THE INVENTION

1. Field of the Invention

This invention relates to cyclotrons and, more particularly to a cyclotron system and method for sensing and monitoring the operation of the cyclotron and the synthesis of a radioisotope into a positron-emitting radio chemical.

2. Description of Related Art

Radioisotope delivery systems have been found to be a cost effective and easy way to automatically produce up to Curie levels of positron-emitting radioisotopes in compounds in a variety of chemical forms. One popular radioisotope delivery system is the CTI RDS-112 Cyclotron which is manufactured by CTI, Inc. of Knoxville, Tenn. and which is available from Siemens Gammasonics, Inc. The standard radioisotope delivery system configuration includes a cyclotron, inter-locking shield, four targets for the production of $^{11}C$, $^{13}N$, $^{15}O$ and $^{18}F$, target utility systems and a chemical synthesis module or unit. The system is fully automated from a cold start to the beginning of isotope production.

The positron-emitting radio chemical, such as $^{18}F$-labeled 2-deoxyglucous may subsequently be injected into a patient and imaged in a positron emission tomography ("PET") scanner. The PET scanner has been found to be useful in providing tomographic images of, for example, a patient's brain.

PET scans are often interrupted, delayed or canceled altogether due to the problems associated with producing the $^{18}F$ positron-emitting isotope. This, in turn, results in inconvenience to the patient and delays in diagnosing and treatment of an illness.

Some portion of the delays or cancellations have occurred due to power fluctuations at the facility where the cyclotron is located. The power fluctuations have caused the vacuum pumps, for example, associated with the cyclotron to fail which causes a cyclotron acceleration chamber to loose its vacuum. This, in turn, interrupts the production of the radioisotope which is required to produce the radio chemical.

Another cause of the cancellations or delays have resulted from shooting or accelerating, for example, a "dry" $^{18}F$ water target (i.e., the target volume not containing target material when exposed to accelerated ions). If the cyclotron continued to accelerate ions towards the "dry" $^{18}F$ water target, the target must be rebuilt which necessitates several hours of rebuild time and downtime.

In the past, target pressure readings associated with a target were used to attempt to monitor this fault condition. The problem with the pressure readings was that they were inaccurate indicators of a target fault and that they required an operator to be present to observe a monitor of the cyclotron.

Other cancellations and delays in the PET scans resulted from failures of the synthesis module in the cyclotron during synthesizing the radioisotope into the positron-emitting radio chemical. The typical production of a positron-emitting radio pharmaceutical from the synthesis module typically took on the order of about 2 hours. After such time, the radio chemical was removed from the synthesis module of the cyclotron and subsequently used in the PET scan. It was sometimes encountered that the synthesis could not proceed properly and, consequently, the desired radio pharmaceutical was not synthesized. Unfortunately, there was no hands-free and convenient way to continuously monitor and observe the synthesis operation.

What is needed, therefore, is a system and method for sensing and monitoring the targets, the vacuum state of the acceleration chamber, as well as the synthesis procedure during the production of the positron-emitting radio chemical.

SUMMARY OF THE INVENTION

It is, therefore, a primary object of this invention to provide a system and method for monitoring the targets, evacuated acceleration chamber and synthesis of the positron-emitting radio chemical.

Another object of the invention is to provide a convenient system and method which will alarm or notify an operator in a manner which will reduce or eliminate the need for presence of an operator during the production of a positron-emitting radio chemical.

Still another object of the invention is to provide a system and method for identifying a cyclotron failure or fault condition and notifying an operator thereof.

Still another object of the invention is to provide a convenient, user-friendly means for determining whether the acceleration chamber is evacuated.

Yet another object of the invention is to provide a system and method for identifying target failures associated with the targets use in the cyclotron.

Another object of the invention is to provide a system and method for visually monitoring the synthesis process.

Yet another object of the invention is to provide a system and method for alarming an operator if one or more of the above-referenced fault conditions occur.

In one aspect, this invention comprises a cyclotron comprising an acceleration chamber, a vacuum device associated with the acceleration chamber for evacuating the acceleration chamber to provide an evacuated acceleration chamber, at least one target situated in the evacuated acceleration chamber, an ion source situated in the evacuated acceleration chamber for providing a supply of ions, an accelerator for accelerating the supply of ions into at least one target to generate an isotope, a synthesis module for receiving the isotope and for combining the isotope with a chemical to provide a radio chemical, a sensing system for sensing the operation of the cyclotron, the sensing system comprising a target sensor for sensing an active target and for generating a target signal corresponding thereto, a vacuum sensor for sensing the vacuum in the evacuated acceleration chamber and for generating a vacuum signal corresponding thereto, a synthesis module sensor for sensing the isotope and for generating a synthesis signal corresponding thereto, a display for receiving the target signal, the vacuum signal and the synthesis signal and for generating a display in response thereto.

In another aspect, this invention comprises a cyclotron monitoring system for monitoring the operation of a computer for monitoring the operation of the cyclotron and a cyclotron comprising a plurality of sensors coupled to the computer and situated on the cyclotron for generating a plurality of signals regarding the operation of the cyclotron and the computer receiving a plurality of signals and generating at least one alarm signal upon the occurrence of a cyclotron failure.

In yet another aspect, this invention comprises a cyclotron system comprising a cyclotron, a plurality of sensors associated with the cyclotron, a computer coupled to the plurality of sensors for receiving sensor signals from the plurality of sensors concerning the operation of the cyclotron, the computer comprising processing means for receiving the sensor signals and for generating a fault signal in response thereto upon the occurrence of a cyclotron failure and communication means for receiving the fault signal and for communicating an alarm to an operator.

In still another aspect, this invention comprises a method for monitoring a cyclotron operation comprising the steps of sensing a plurality of conditions associated with the cyclotron and alarming an operator if a fault condition is encountered.

In still another aspect, this invention comprises a method for making a radio chemical using a cyclotron, the method comprising the steps of using an evacuated acceleration chamber situated in a magnetic field, generating a source of ions, accelerating the ions into at least one target to produce a radioisotope and synthesizing the radioisotope to produce the radio chemical, sensing a plurality of conditions associated with the cyclotron and alarming an operator if a fault condition is encountered.

These and another objects and advantages of the invention will be apparent from the following description, the accompanying drawings and the appended claims.

BRIEF DESCRIPTION OF THE DRAWINGS

FIG. 4 is a schematic diagram of a method in accordance with one embodiment of the invention;

FIGS. 5*a*–5*c,* taken together, is a schematic diagram illustrating an acquisition procedure for acquiring and evaluating the target and vacuum signals sensed;

FIG. 6 is a schematic diagram of a synthesis procedure in accordance with one embodiment of the invention and features associated with the synthesis display illustrated in FIG. 3;

DESCRIPTION OF THE PREFERRED EMBODIMENT(S)

Figure 1:
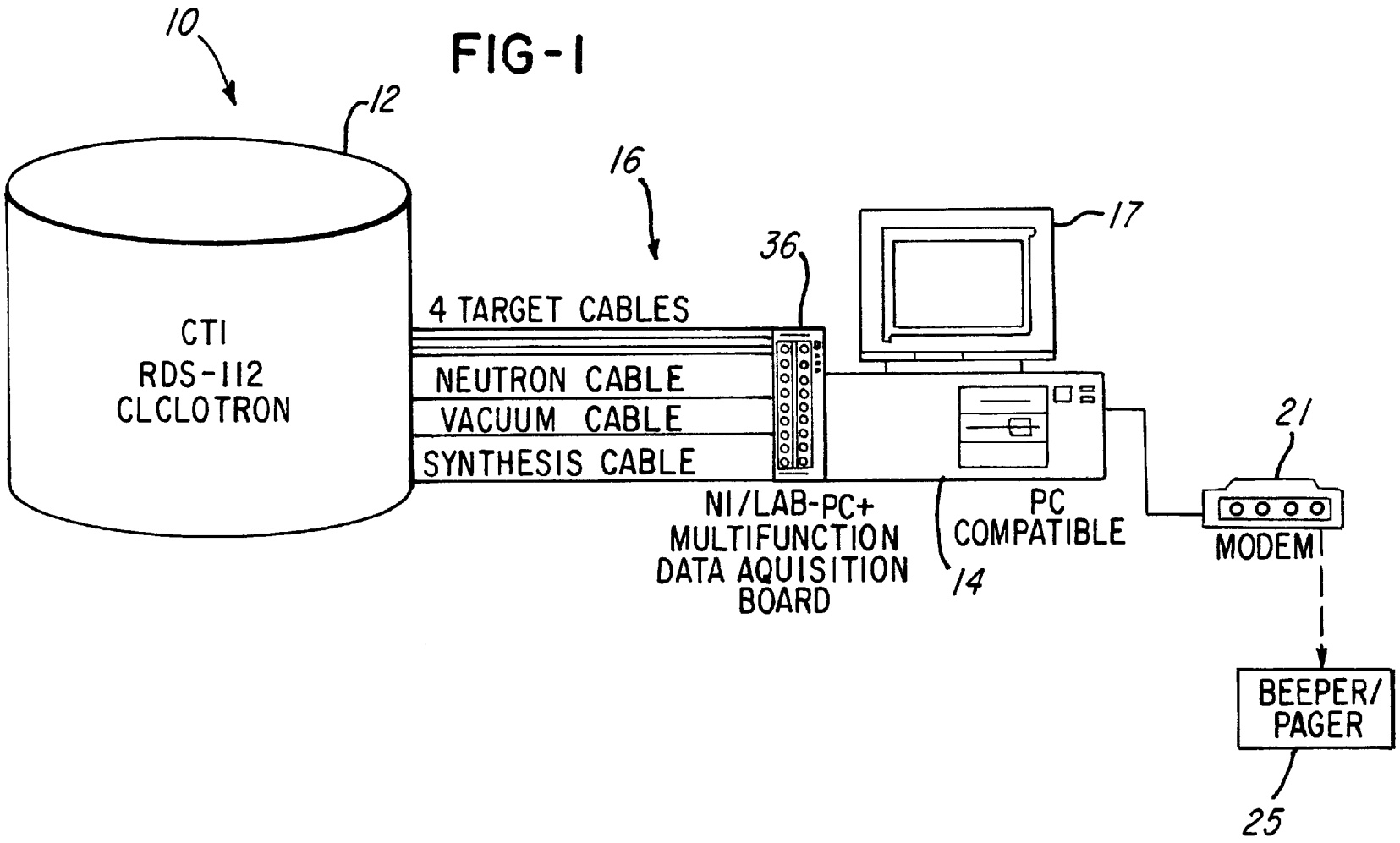
FIG. 1 is a schematic view of a cyclotron and sensing system incorporating features of the present invention.

Referring now to FIG. 1, a cyclotron system 10 comprising features of the present invention is shown. The cyclotron system 10 comprises a cyclotron 12 which, in the embodiment being described, may be a Model No. CTI RDS-112 Cyclotron available from CTI, Inc. of Knoxville, Tenn. or Siemens Gammasonics, Inc. of Hoffman Estates, Ill. In general, the function of the cyclotron system 10 is to produce a positron-emitting radio chemical which may be subsequently injected into a patient during a positron-emitting tomography (PET) scanning procedure.

The cyclotron system 10 further comprises a monitoring or sensing system or sensing means 16 for sensing and monitoring the operation of the cyclotron system 10 and for generating at least one alarm signal on the occurrence of a cyclotron failure or fault condition as will be described later herein.

Figure 2:
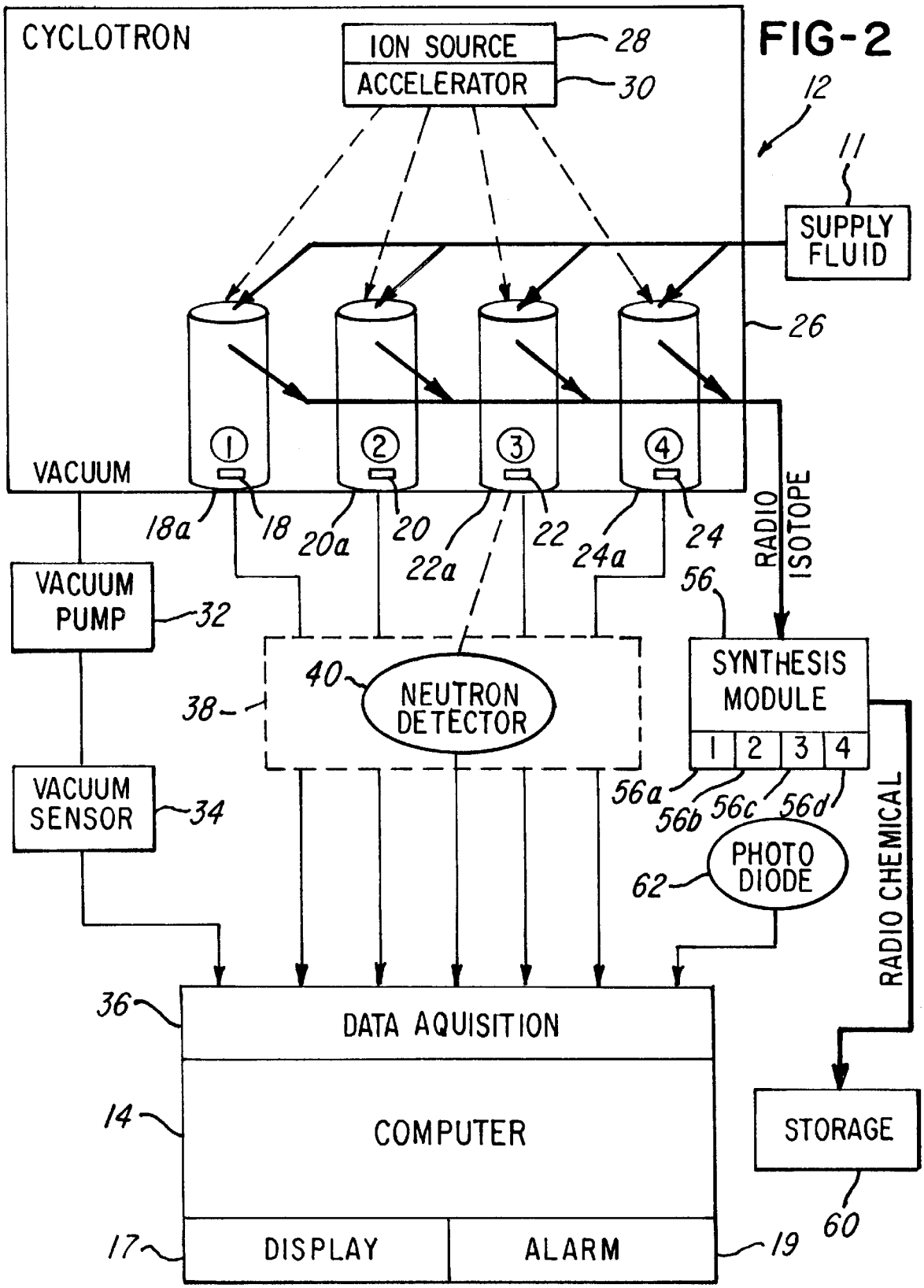
FIG. 2 is another schematic view showing more details of the present invention.

As schematically illustrated in FIG. 2, the cyclotron 12 comprises a plurality of targets 18, 20, 22 and 24 which are situated in respective chambers or target holders 18*a*–20*a*. Some of the typical targets which may be positioned in target holders 18*a*–20*a* include $^{11}C$, $^{13}N$, $^{15}O$ and $^{18}F$. Notice that the targets 18–24 are situated in a vacuum chamber 26 of cyclotron 12 where they are bombarded with a plurality of ions (not shown) from an ion source 28 after the ions are accelerated by an accelerator 30 situated in the vacuum chamber 26. If the vacuum chamber 26 is not evacuated properly, then the cyclotron 12 will not be able to generate quantities of radioisotopes which are necessary to produce the positron-emitting radio chemical. Thus, cyclotron 12 comprises a pump 32 for evacuating chamber 26 to provide an evacuated acceleration chamber 26. The vacuum pump 36 is coupled to and activated by a cyclotron controller (not shown) which controls the operation of cyclotron 12.

Cyclotron monitoring system 16 comprises a vacuum sensor 34 for monitoring or sensing whether the acceleration chamber 26 is evacuated and for generating a vacuum signal corresponding thereto. In this regard, the on/off signal for energizing vacuum pump 32 is monitored, with the signal being connected an input/output port of a multi-function data acquisition board 36 coupled to computer 14. In general, if vacuum sensor 34 determines a voltage of at least 5 volts, then evacuation of chamber 26 is inferred. If less than 5 volts is detected, then it is presumed that the chamber 26 is not properly evacuated. The computer 14 receives the sensed vacuum signal and may generate an alarm in response thereto as described later herein. One suitable data acquisition board is the National Instruments NI/Lab-PC+ Multifunctional Data Acquisition Board available from National Instruments of Austin, Tex.

The cyclotron monitoring or sensing system 16 further comprises a target sensor 38 for sensing various target conditions, such as current consumption and neutron emission, relative to one or more of the targets 18–24 and for generating a target signal corresponding thereto. In this regard, target sensor 38 comprises target cables 38*a*–38*d* (FIG. 1) coupled to a cyclotron current source (not shown), such as a current amplifier board in cyclotron 10 (not shown) which energizes each target 18–24 with an appropriate current. The target sensor 38 monitors or senses the current delivered to each target 18–24, and this information is received by data acquisition board 36 which comprises a programmable software-controlled multiplexer 44 (FIG. 3) for enabling a particular target current for a target 18–24 to be selected by an operator. In the illustration being described, the current level for any selected target may be extracted from the current amplifier board (not shown) located in the cyclotron 12. These target currents are fed from the data acquisition board 36 to computer 14 which processes the target current information as described below.

The target sensor 38 (FIG. 2) further comprises a neutron detector 40 for measuring neutron flux over approximately six decades emitting from one or more of the targets 18–24. In the embodiment being described, the neutron detector 40 is a slow neutron fission detector which is loosely mounted or situated between targets 20 and 22 as shown. The neutron detector 40 generates a zero to five volt signal which is fed into a pulse counter 46 coupled to analog-to-digital converter 48 situated on data acquisition board 36. The computer 14 receives the target current and sensed neutron flux and generates a graphical representation, such as is shown in the displays 52 (FIG. 3) and 50, respectively.

It has been found empirically that there is a direct correlation between a current being supplied to a particular target, such as target 20 and that targets associated neutron. In general, the current supplied to the targets 18–24 and resultant neutron emission should vary directly.

Figure 3:
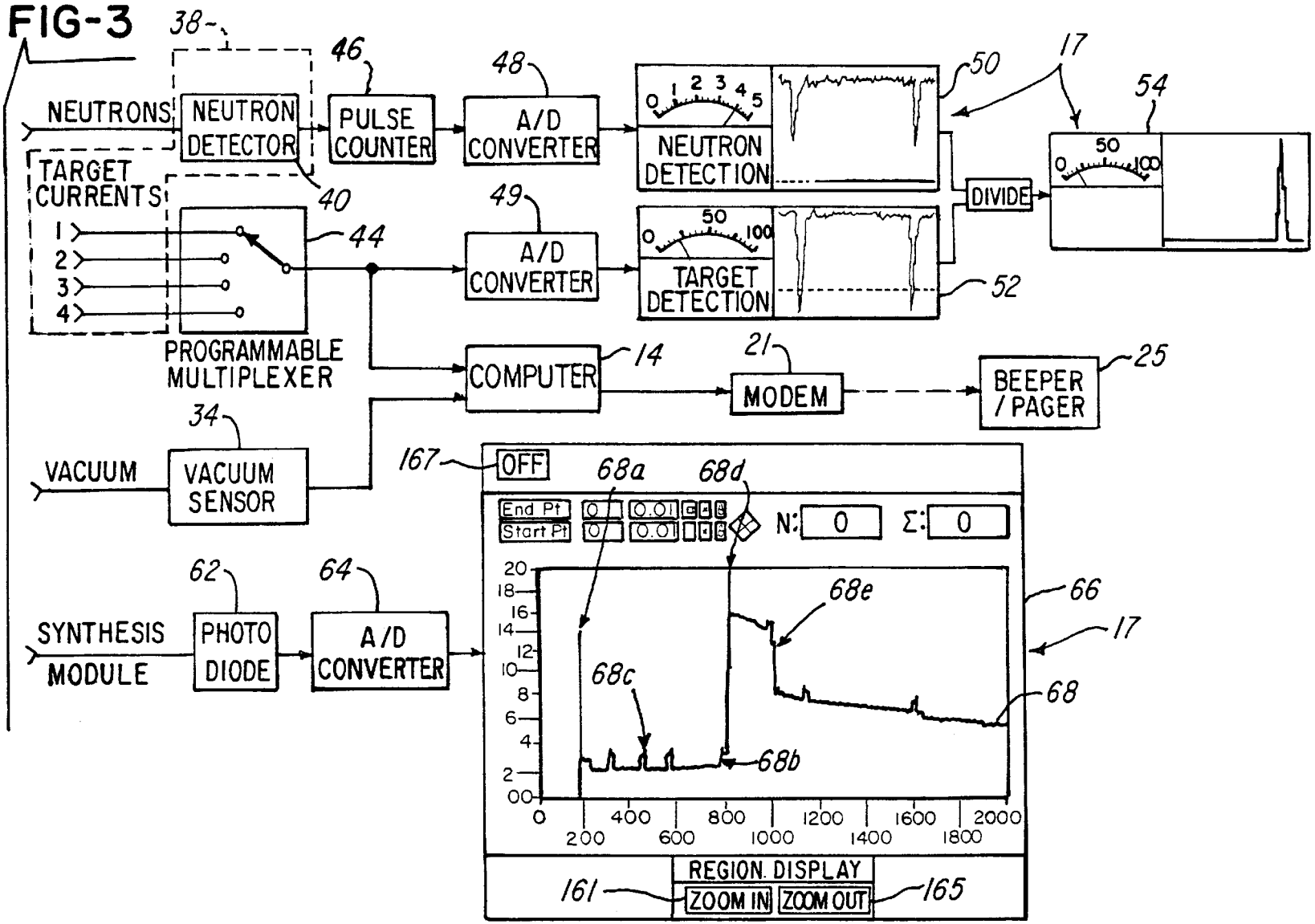
FIG. 3 is a view showing the various signals and associated displays which may be generated on a display monitor coupled to a computer for receiving the sensed signals.

As best illustrated in FIG. 3, the current and neutron targets signals generated by analog-to-digital convertors 48 and 49 are divided by computer 14 to provide a resultant target signal ratio which may be displayed in the form shown by display 54.

Sensing system 16 comprises a display or monitor 17 coupled to computer 14 for receiving the signals from data acquisition board 36 and for generating visual displays corresponding thereto. Although not shown, a printer may be coupled to computer 14 and used to print the displays 50, 52 and 54 if desired. In the embodiment being described, the computer 14 comprises a PC compatible computer having at least a 486 microprocessor and 8 megabytes of ram running the Windows 3.1 operating system available from Microsoft Corporation of Bellevue, Wash. The graphical programming software entitled "LabView" available from National Instruments of Austin, Tex. has been helpful for programming the data acquisition board 36, control and user interfaces and displays for processing and displaying signals received by data acquisition board 36. The displays 50–54 illustrated in FIG. 3 are typical of the displays that may be used, but other configurations or form of displays may be selected.

In the manner conventionally known, as a supply fluid 11 (FIG. 1) is processed through target holders 18*a*–24*a* as the targets 18–24 are being bombarded with accelerated ions from accelerator 30, thereby producing a 15 radioisotope which is transferred to a synthesis module 56 (FIG. 2). The synthesis module 56 synthesizes the radioisotope to produce a radio chemical which is then used in the PET scanning process. Notice that the synthesis module 56 comprises a plurality of serially-connected synthesis vessels 56*a*–56*d* which synthesize the radioisotope into the radio chemical in a manner conventionally known. Thus, it is important to understand that the radioisotope is progressively transferred from synthesis vessel 56*a* to vessel 56*b*, from vessel 56*b* to vessel 56*c* and from vessel 56*c*, to vessel 56*d*. Once synthesized, the radio chemical is stored in storage container 60.

The sensing system 16 further comprises a synthesis sensor or sensing means for sensing the isotope during the synthesis process and for generating a synthesis signal corresponding thereto. In the embodiment being described, the synthesis sensor comprises a photo diode 62 for sensing the photon emission associated with one or more of the vessels 56*a*–56*d*. In this regard, the photo diode 62 is situated loosely, for example, between vessels 56*b* and 56*c* such that it can detect the photon emission from either or both of the vessels 56*b* and 56*c* during the synthesis procedure.

It has been found empirically that because the radiation per cubic centimeter is fixed and is on the order of about 200 mci, the photon emission detected by photo diode 62 directly corresponds with the rate at which the radioisotope is being transferred between the vessels 56*a*–56*d* in the synthesis module 56. As illustrated in FIGS. 2 and 3, the signal from the photo diode 62 is received by a analog-to-digital convertor 64 on board 36 which generates a digital signal which may be displayed in the form of the display 66 illustrated in FIG. 3.

By way of illustration, notice that the display 66 comprises a graph 68 with its Y axis representing photon emission (and, consequently, corresponding rate of flow). Thus, at point 68*a*, the vessel 56*a* begins filling until fluorination occurs at approximately point 68*b* whereupon the radioisotope is transferred (point 68*d*) from synthesis vessel 56*a* to vessel 56*b*. At this point, the rate of flow of the radioisotope between vessels 56*a* and 56*b* increases as the vessel 56*b* begins filling. This flow increase causes an increase in the radiation detected by photo diode 62 which is then displayed as illustrated. Thus, the photo diode 62 has been useful in sensing the various transfer stages of the radioisotope between synthesis vessels 56*a*–56*d*, and consequently, the synthesis of the radio chemical as it progresses.

In the embodiment being described, one suitable photo diode is the Hammamatsu Model No. S2281 available from Hammamatsu of Tokyo, Japan. Also, one suitable neutron detector 40 has been found to be the LND Model 3004 available form LND, Inc. of Oceanside, N.Y.

Notice that the cyclotron system 10 further comprises an alarm means or an alarm system 19 coupled to computer 14 which may include a sound alarm (not shown), a monitor alarm (not shown) for displaying an alarm on monitor 17. Alternatively the alarm system 19 of computer 14 may comprise either an internal or external fax modem 21 (FIG. 1) which may initiate an operator notification procedure, such as by a pager or beeper 25, upon the occurrence of a cyclotron failure or other cyclotron fault or monitor condition. A method and procedure for monitoring the status of the cyclotron 12 will now be described relative to FIGS. 4–6.

The method begins at block 71 by initializing various variable and thresholds used by the sensing system 16 using an input device (not shown) such as a mouse or keyboard coupled to computer 14 and display 17. In the embodiment being described, the computer 14 generates user-friendly interfaces of the type shown in FIGS. 7–10. For example, notice in FIG. 7 that an electronic interface or display 70 may be displayed by computer 14 on display 17. This display 70 may incorporate the displays 50, 52 and 54 mentioned earlier herein.

This main display 70 provides an alarm reset 75 for resetting the alarm system 19 after it has been initiated. The display 70 also comprises a software-controlled target selector 72 which controls the programmable multiplexer 44 (FIG. 3) for identifying and selecting the target 18–24 to be monitored. The main display 70 may further comprise a configuration switch 74 for initializing and configuring various variables, including alarm 76 and target settings 78, as well as beeper test switches 79 for testing the beeper/pager 25 which are desired to be notified in the event of a cyclotron failure or fault condition.

It should be appreciated that the computer 14 may read the preference or default settings for the various alarm and target variables from memory (not shown). In this regard, if a neutron target display switch 78 (FIG. 7) is initiated, a neutron and target configuration display 80 (FIG. 8) is provided for configuring and initializing the neutron detector 38 as well as predetermined minimum current levels for each target 18–24. Also, a range and multiplier which computer 14 uses for generating the displays 50, 52 and 54 may also be established using the software-controlled electronic switches or pots 82 and 84 respectively.

Figure 9:
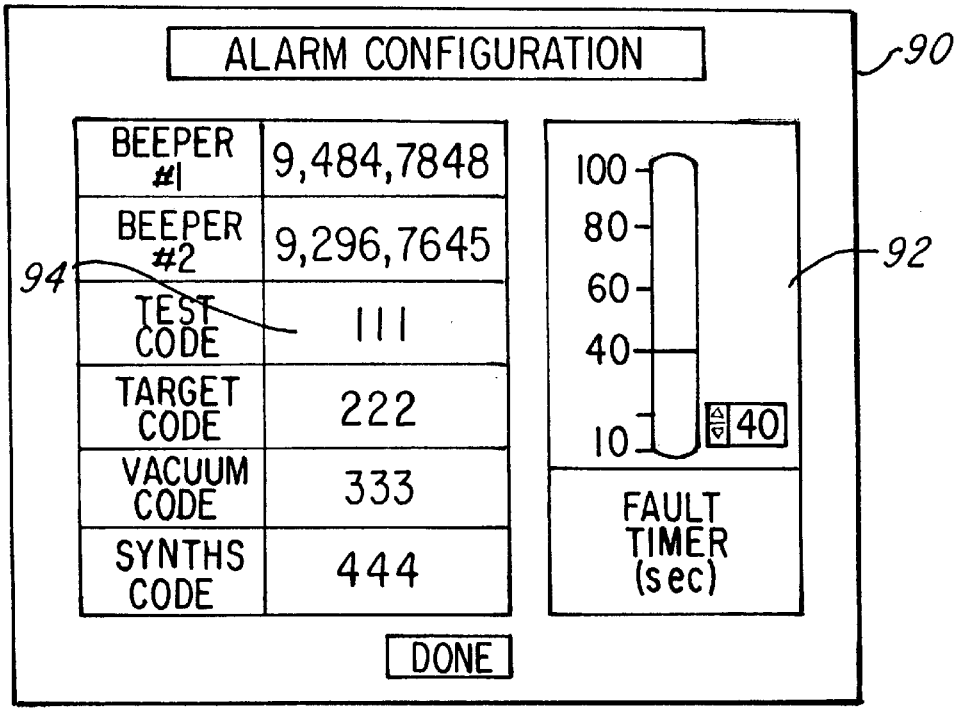
FIG. 9 is a view of a display or user interface which may be utilized to configure the alarms in accordance with another embodiment of the invention.

If it is desired to configure the alarm settings, then the alarm button 76 (FIG. 7) on display 70 is initiated whereupon computer 14 generates screen 90 (FIG. 9). In the embodiment being described, an alarm default configuration is stored in computer 14 and comprises beeper/pager numbers to dial in the event of a cyclotron failure or fault may be altered. In addition, various alarm codes 94 for informing an operator of a test target fault, vacuum fault and/or synthesis module fault may be established and stored in computer 14 using display (90).

Display 90 also comprises a fault timer 92 for providing an alarm countdown in seconds from an onset of a cyclotron failure or fault condition until an alarm is sent and a beeper/pager number is initiated to notify or alarm an operator or technician.

It should be appreciated that, initially, default configurations for the alarm 19 and each target 18–24 are stored and read by computer 14 using a hardware configuration file (not shown), an alarm configuration file (not shown) or a neutron/target configuration file (not shown). Once the target and alarm variables are initialized and configured, the method enters the acquisition loop (block 73 in FIG. 4) where the actual signal sensing, acquisition, monitoring and timing take place.

Figure 5C:
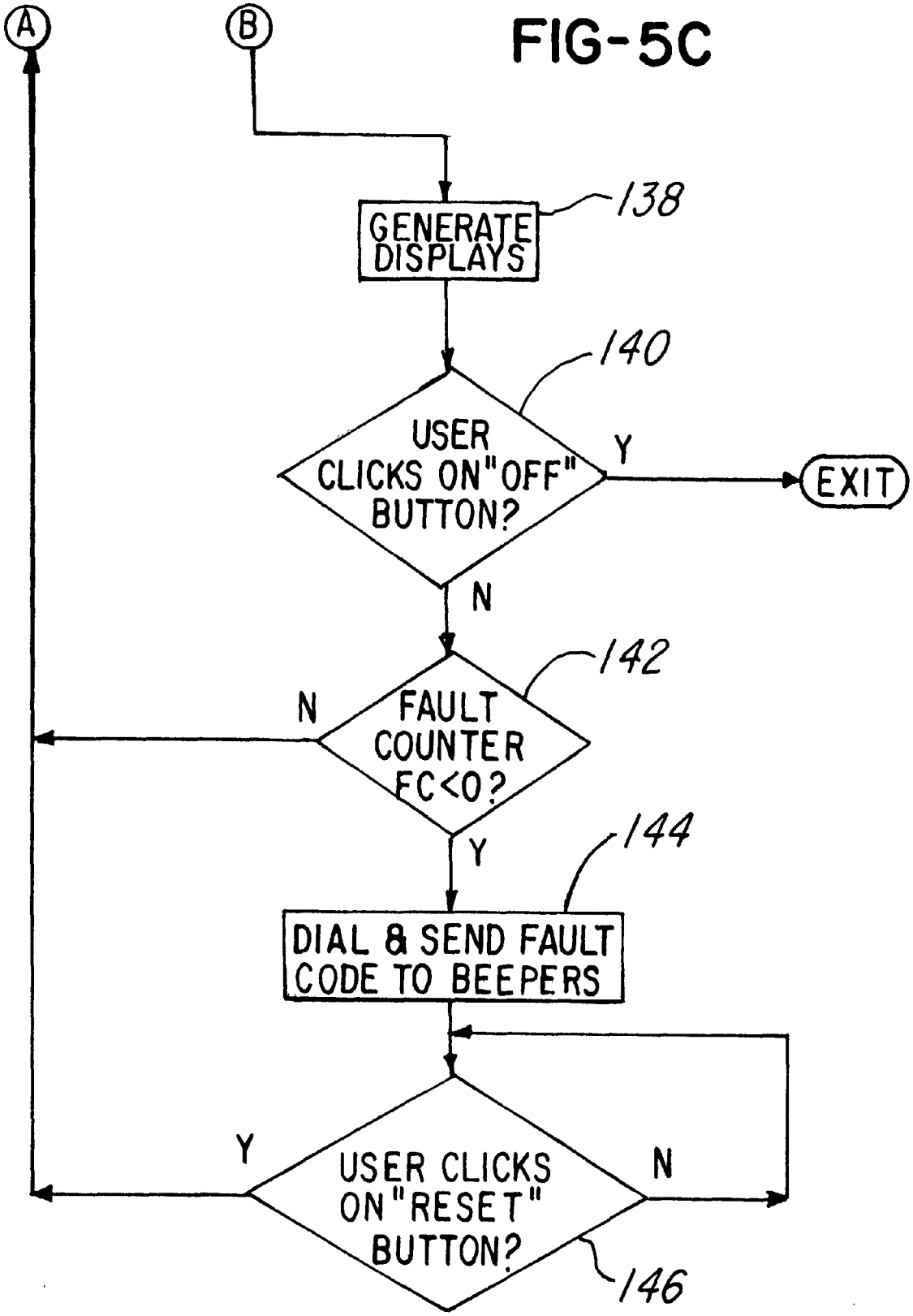

This portion of the method or procedure will be described relative to FIGS. 5*a*–5*c* which begins by displaying interface 70 (FIG. 7) at block 91 (FIG 5A). At decision block 93, if the user initiated one of the beeper test buttons 79, then an alarm test code (like code 94*a* in FIG. 9) is dialed and sent to that beeper number to test the operation of the alarm (block 95). Thereafter or if the decision at decision block 93 is negative and the user initiates the neutron target button 78 (FIG. 7) at decision block 96, then the routine displays the default neutron/target configuration settings display 80 (FIG. 8) at block 98. If the user chooses to alter one or more of the configuration settings (block 100), then the altered settings are stored in a neutron/target configuration file (not shown) in computer 14 at block 102.

Figure 7:
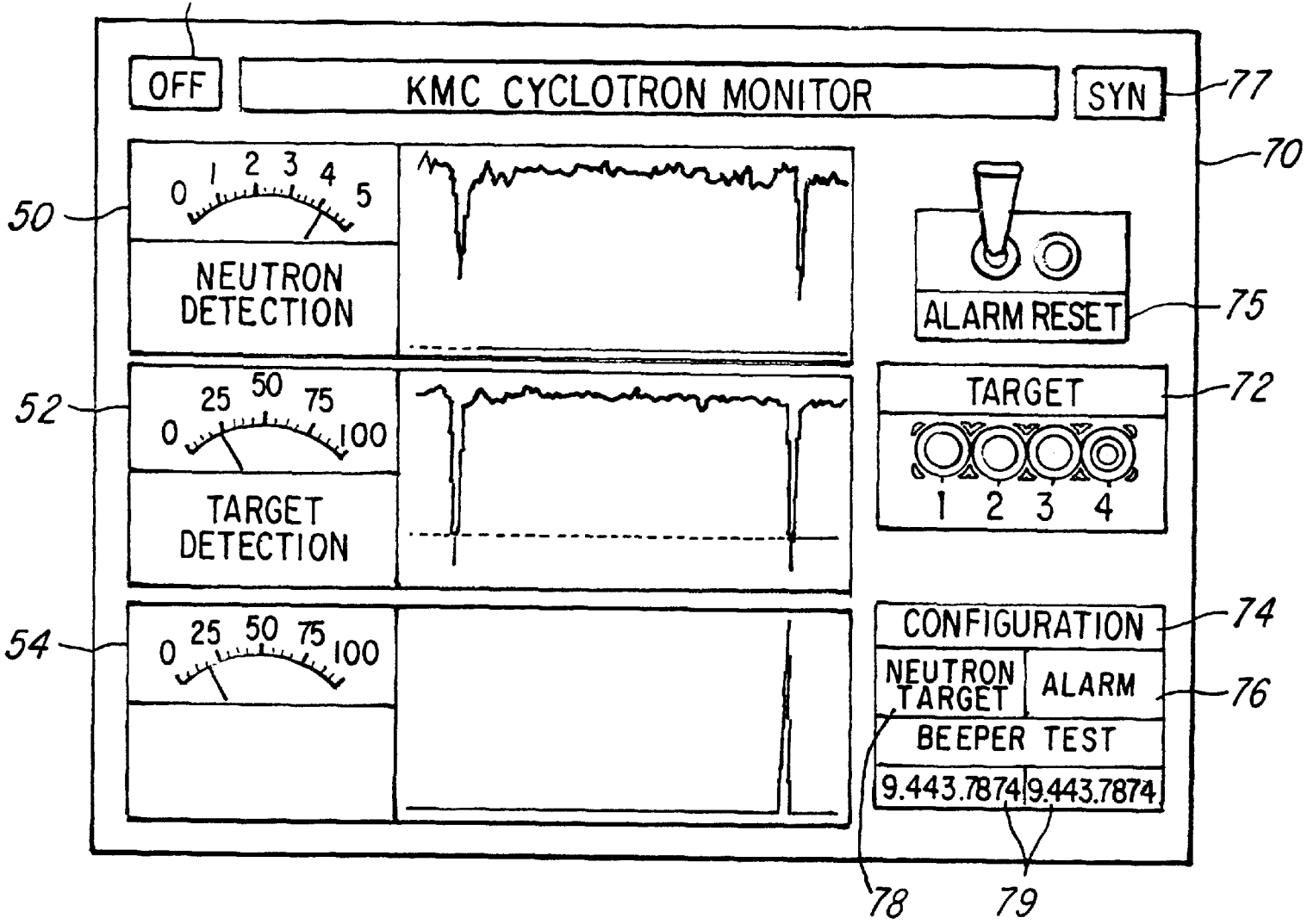
FIG. 7 is a view of a main cyclotron monitor display which may be utilized in one embodiment of the invention.
Figure 8:
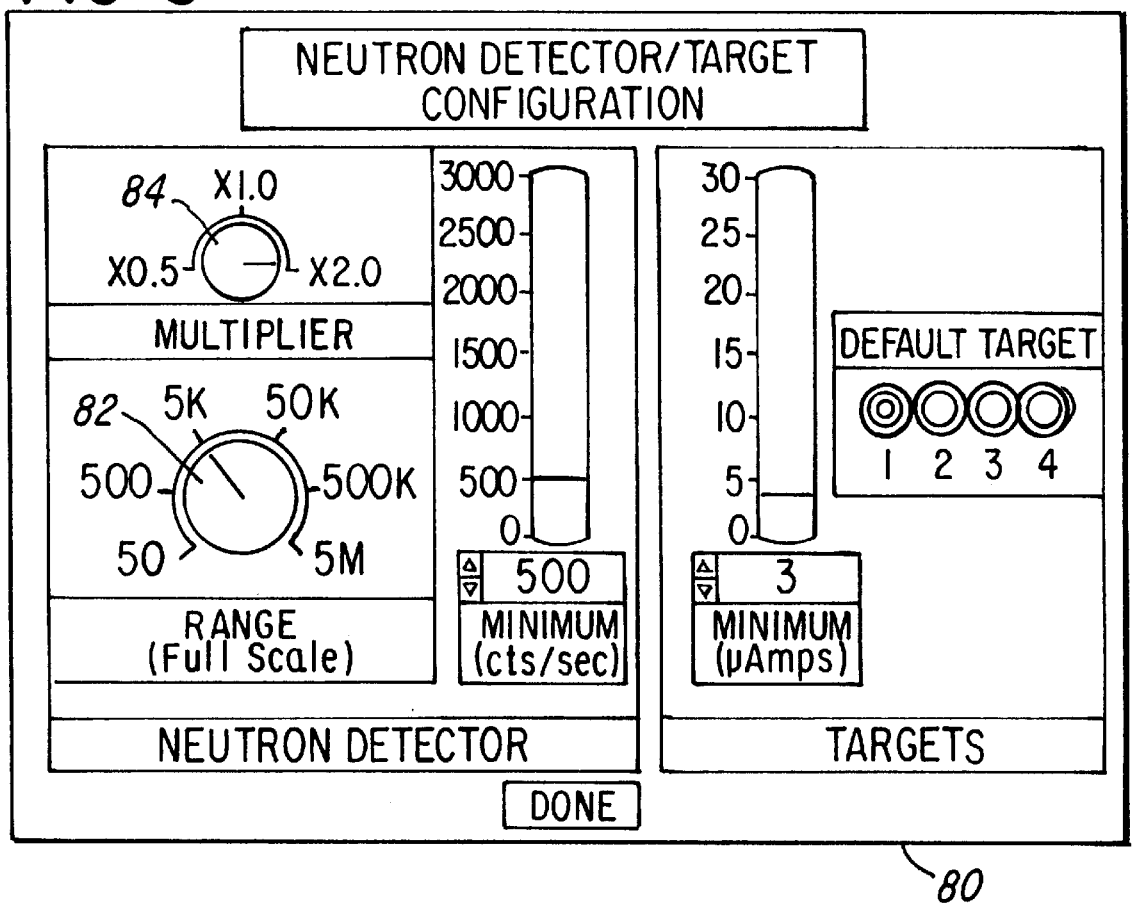
FIG. 8 is a view of a display which may be utilized to configure the neutron detector sensor and targets.

If the decision at decision block 100 is negative or after storing the configuration settings at block 102, the routine loops back to decision block 104 where it is determined if the user desires to change alarm configuration settings by initiating the alarm button 76 (FIG. 7). If the alarm button 76 was initiated, then the alarm configuration display 90 (FIG. 9) is displayed (block 106 in FIG. 5A). At decision block 108 the user may alter one or more of the alarm configuration settings. If the alarm configuration settings are altered, then the new alarm configuration settings are stored in an alarm configuration file (not shown) in computer 14 (block 110). Thereafter or if the decision at decision block 108 is negative, then the routine will proceed to decision block 112 as shown.

At decision block 112, it is determined whether the user initiated a synthesis button 77 (FIG. 7) which would initiate a synthesis monitoring routine (block 114) described later herein relative to FIG. 6. If the decision at decision block 112 is negative, then the method begins monitoring and sensing neutron voltage, target currents for a chosen target, such as target 20, and the vacuum signal at blocks 116, 188 and 120, respectively. As described earlier herein, these signals are generated from target sensor 38, and vacuum sensor 34, respectively. It should be apparent that the computer 14 generates the display 70 and can process operator's selections in any order. Thus, the sequence of operation mentioned herein is intended for illustration only.

Initially, a neutron voltage (N) corresponding to a neutron flux is sensed by neutron detector 40 and measured by data acquisition board 36 and a digital signal corresponding thereto is generated by A/D converter target 48 (FIG. 3). The target current associated with the selected target is also sensed by target sensor 38 and measured by data acquisition board 36 (block 118 in FIG. 5A) and a digital signal corresponding thereto is generated by A/D converter 49. These sensed input signals are substantially simultaneously displayed by computer 14 on display 17 in the form of the displays 50, 52 and 54 shown in FIGS. 3 and 7.

At block 120, vacuum sensor 34 measures the voltage associated with vacuum pump 32 in the manner described earlier herein.

Once the vacuum and target signals are sensed, measured, and displayed by computer 14 and sensing system 16, the routine proceeds to determine whether or not a cyclotron failure has occurred at decision blocks 122, 126 and 130. At decision block 122, it is determined whether the neutron voltage (N) is less than a predetermined minimum established using configuration display 80 (FIG. 8) or which was previously stored in neutron/target configurations file (not shown) in computer 14. If the neutron voltage (N) detected is less than a predetermined minimum, such as a $^{18}$F target, and the target current (C) supplied to the target is greater than a predetermined minimum current, such as a $^{18}$F target, then a neutron fault is identified (block 124 in FIG. 5B). Stated another way, the fault identified at decision block 122 indicates that, while current is being supplied to a target, the neutrons detected by neutron detector 40 are less than the predetermined minimum which should be generated for that selected target for the current level supplied to the target.

At decision block 126, it is determined whether a target current (C) is less than a predetermined minimum target current and whether the neutron voltage (N) is greater than the minimum neutron voltage value. If they are, then the routine proceeds to block 128 where a current fault is indicated. This fault indicates that, while a minimum number of neutrons are being detected by neutron detector 40, the current supplied is less than the minimum amount of current required for this level of neutron emission.

If the decision at decision block 126 is negative, then the routine proceeds to decision block 130 where vacuum sensor 34 (FIG. 2) determines whether the vacuum signal is off which would indicate that the chamber 26 is not being properly evacuated. If the decision at decision block 130 is yes, then a vacuum fault is indicated (block 132 in FIG. 5B). If the decision at decision block 130 is negative, then the routine proceeds to block 134 where a fault counter (FC) is reset to a default counter value (stored in computer 14) and which generally corresponds to a minimum number of faults before an alarm will be indicated.

After blocks 124, 128 and 132, the routine proceeds to decrement fault counter (block 136) as shown.

The method continues at block 138 where computer 14 generates display 54 (FIG. 7) on monitor 17 (FIG. 1) to provide a visual indication of the ratio between neutron voltage (N) and current (C) ratio for the chosen target. The ratio display 54 (FIG. 7) provides a visual representation of the neutron/current.

At decision block 140, it is determined whether or not the user has initiated a software-controlled on/off switch 81 (FIG. 7) whereupon the routine exits as shown. If the decision at decision block 140 is negative, then computer 14 determines whether fault counter FC is less than zero at decision block 142. If it is not, then the routine loops back to block 93 (FIG. 5A) as shown.

If the decision at decision block 142 is affirmative, then a cyclotron failure is presumed and computer 14 initiates an alarm 19 (FIG. 2). In the embodiment being described, computer 14 initializes a modem 21 to dial and send one or more fault codes 94 (FIG. 9) to an operator, for example, using beeper/pager 25 (FIG. 1) at block 144.

At this point, an operator or technician responding to the alarm 19 evaluates the fault conditions sensed and services the cyclotron system 10 or, perhaps, shuts down the cyclotron 12 altogether. It is contemplated that the computer 14 could be coupled directly to the cyclotron controller (not shown) of cyclotron system 10 in order to initiate an automatic shut down of cyclotron 12. This may be advantageous in that it would provide a closed-loop system and method for controlling the operation of the cyclotron system 10.

Once the cyclotron 12 has been serviced the technician or user may reset the alarm using reset button 75 (FIG. 7) at decision block 146 (FIG. 5C). If the user initiated the reset button 75, then the routine proceeds back to block 90 as shown. If the decision at decision block 146 is negative, then the routine loops back as shown.

Advantageously, this system and method provide means for detecting a neutron failure, current failure and/or vacuum failure before such failures or conditions result in a catastrophic failure which would interrupt, delay or prevent the cyclotron system 10 from generating the desired radio chemical. For example, a target current may be on the order of about 20 microamperes for a $^{18}$F fluromethane. Typically, this would yield a neutron flux of on the order of about 500 mCi. By generating an alarm using established predetermined minimum levels, such as a minimum current level of 20 microamperes and a predetermined minimum neutron flux level of about 4000 neutrons/sec for this target current, a full target rebuild may be avoided because the alarm would identify a potential cyclotron failure before a complete target rebuild is necessary.

In addition, the system and method for monitoring evacuation of acceleration chamber 26 provides a convenient indication of whether acceleration chamber 26 has been evacuated. This avoids radioisotope production failures due to the lack of an evacuated acceleration chamber 26.

As mentioned earlier herein, if the user initiates a synthesis button 77 (FIG. 7) at decision block 112 (FIG. 5A), then the routine begins a synthesis monitor routine which will now be described relative to FIG. 6. The routine begins at block 150 by displaying a synthesis display 66 (FIG. 3). At block 152, photo diode 62 senses the radiation generated, for example, between synthesis vessels 56*b* and 56*c*. A/D converter 64 provides a digital signal which computer 14 and data acquisition board 36 use to generate image 68 to provide a direct indication of the synthesis process.

At block 154, the computer 14 displays the graphical image 68 (FIG. 3) representing the various voltage levels sensed by photo diode 62. This, in turn, provides an indication of the synthesis of the radio chemical. These synthesis stages include, for example, filling a first vessel 18 with a radioisotope (point 68*a* on graph 68 in FIG. 3), topping off (point 68*c*) the vessel 18*a*, fluorination (point 68*b*), transferring the radioisotope from one vessel 18 to another (e.g., points 68*c* and 68*d*) and resultant hydrolysis (point 68*e*) that occurs.

In the embodiment being described, the user is provided with means for changing the visual display by selecting the number of curve points plotted (block 156 in FIG. 6) and the area beneath the curve (block 158) to provide the user with more detail regarding the image 68 and the synthesis process.

Moreover, this monitoring system and method may further comprise means for enhancing the monitoring and visual display image 68 information relative to the synthesis process. In this regard, at decision block 160 (FIG. 6), the user may initiate a zoom-in button 161 (FIG. 3) whereupon a curve (not shown) between two display cursors (not shown) on display 17 are displayed (block 162). Thereafter, or if the decision at decision block 160 is negative, then the routine proceeds to decision block 164 where its determined if the user has initiated a zoom-out button 165 (FIG. 3). If he has, then the routine zooms-out and displays an entire curve occupying the entire visual portion of the display 66 (block 166). Therafter or if the decision at decision block 164 is negative, then it is determined whether the user has initiated an off button 167 (FIG. 3) at decision block 168. If he has, then the method exits. Otherwise, it loops back to block 152 as shown.

Advantageously, this system and method provide means for not only alarming an operator of a cyclotron fault condition or failure, but also sensing, displaying and monitoring the synthesis procedure which occurs during the production of a positron-emitting radio chemical, such as $^{18}$F Deoxyglucous, which may be subsequently injected into a patient and imaged using a PET scanner (not shown).

The system and method of the present invention are also advantageous in that they eliminate or reduce the need for the physical presence of an operator at the cyclotron 12 during operation which, for some targets can take many hours. Given that the production of the radio chemical may occur over a relatively long period, this is obviously advantageous because it frees the operator to perform other tasks while the cyclotron system 10 is producing the desired radio chemical.

The system and method also provide convenient means for alarming an operator before a fault condition, such as a dry target, and subsequently triggering an alarm which may comprise the beeper/pager 25 (FIG. 1) to notify a radiochemist or service engineer or technician before a cyclotron failure or fault condition turns into a catastrophic failure resulting in downtime, cancellation or unduly long periods of delay in producing the radio chemical.

The system and method also facilitate easy trouble shooting and isolation of a problem before any action is taken by the radiochemist or technician. This, in turn, results in improved efficiency of use of cyclotron 12 and identification, isolation and correction of cyclotron 12 failures before they become too serious.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined on the appended claims.

What is claimed is:

1. A cyclotron comprising:

an acceleration chamber;

a vacuum device associated with said acceleration chamber for evacuating said acceleration chamber to provide an evacuated acceleration chamber;

at least one target situated in said evacuated acceleration chamber;

an ion source situated in said evacuated acceleration chamber for providing a supply of ions;

an accelerator for accelerating said supply of ions into said at least one target to generate an isotope;

a synthesis module for receiving said isotope and for combining said isotope with a chemical to provide a radio chemical;

a sensing system for sensing the operation of the cyclotron, said sensing system comprising:

a target sensor for sensing an active target and for generating a target signal corresponding thereto;

a vacuum sensor for sensing the vacuum in said evacuated acceleration chamber and for generating a vacuum signal corresponding thereto;

a synthesis module sensor for sensing said isotope and for generating a synthesis signal corresponding thereto; and a display for receiving said target signal, said vacuum signal and said synthesis signal and for generating a display in response thereto.

2. The cyclotron as recited in claim 1 wherein said cyclotron further comprises:

an alarm generator for receiving said target signal, said vacuum signal and said synthesis signal and for generating an alarm if there exists a neutron fault, a current fault or a vacuum fault.

3. The cyclotron as recited in claim 2 wherein said alarm generator comprises an alarm to at least one remote receiving unit, said alarm generating communicating with said at least one remote receiving unit.

4. The cyclotron as recited in claim 1 wherein said target sensor comprises a neutron detector associated with said target for monitoring a neutron flux associated with said isotope.

5. The cyclotron as recited in claim 4 wherein said neutron detector comprises a slow neutron fission detector.

6. The cyclotron as recited in claim 4 wherein said cyclotron further comprises:

an alarm generator for receiving said target signal, said vacuum signal and said synthesis signal and for evaluating said signals and determining if there is a neutron fault, a current fault or a vacuum fault and for generating an alarm in regards thereto.

7. The cyclotron as recited in claim 1 wherein said synthesis module sensor comprises a photo diode.

8. The cyclotron as recited in claim 7 wherein said cyclotron further comprises:

an alarm generator for receiving said target signal, said vacuum signal and said synthesis signal and for evaluating said signals and determining if there is a neutron fault, a current fault or a vacuum fault and for generating an alarm in response thereto.

9. The cyclotron as recited in claim 1 wherein said vacuum sensor comprises a voltage monitor coupled to a voltage supply line coupled to said vacuum device for monitoring an on/off voltage associated with said vacuum device.

10. The cyclotron as recited in claim 9 wherein said cyclotron further comprises:

an alarm generator for receiving said target signal, said vacuum signal and said synthesis signal and for evaluating said signals and determining if there is a neutron fault, a current fault or a vacuum fault and for generating an alarm in response thereto.

11. A cyclotron monitoring system for monitoring the operation of a cyclotron; and a cyclotron comprising:

a plurality of sensors coupled to said computer and situated on said cyclotron for generating a plurality of signals regarding the operation of said cyclotron; and said computer receiving a plurality of signals and generating at least one alarm signal upon the occurrence of a cyclotron failure;

wherein said cyclotron failure is a vacuum failure.

12. The cyclotron monitoring system as recited in claim 11 wherein said plurality of sensors comprises a target sensor for sensing an active target and for generating a target fault signal corresponding thereto;

an alarm coupled to said computer for receiving said target fault signal and generating said at least one alarm signal in response thereto.

13. The cyclotron monitoring system as recited in claim 11 wherein said cyclotron monitoring system comprises a modem and at least one remote receiving unit, said modem communicating with said at least one remote receiving unit in the event of a cyclotron failure.

14. The cyclotron monitoring system as recited in claim 13 wherein said system further comprises a display for receiving said sensor signals and for generating a display in response thereto.

15. A cyclotron monitoring system for monitoring the operation of a cyclotron; and a cyclotron comprising:

a plurality of sensors coupled to said computer and situated on said cyclotron for generating a plurality of signals regarding the operation of said cyclotron; and said computer receiving a plurality of signals and generating at least one alarm signal upon the occurrence of a cyclotron failure;

wherein said cyclotron failure is a synthesis failure.

16. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure; said plurality of sensors capable of sensing a dry target, a vacuum failure and a synthesis failure; and wherein said cyclotron failure comprises said dry target, said synthesis failure or said vacuum failure.

17. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure; and wherein said plurality of sensors comprises a vacuum sensor for sensing the presence of a vacuum in said evacuated acceleration chamber and for generating a vacuum fault signal corresponding thereto;

an alarm coupled to said computer receiving said vacuum fault signal and generating said at least one alarm signal in response thereto.

18. The cyclotron monitoring system as recited in claim 17 wherein said vacuum sensor comprises a voltage monitor coupled to a voltage supply line for monitoring the voltage supplied to a vacuum device for evacuating an acceleration area of said cyclotron.

19. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure;

wherein said plurality of sensors comprises a target sensor for sensing an active target and for generating a target fault signal corresponding thereto;

wherein said plurality of sensors comprises a vacuum sensor for sensing the vacuum in said evacuated acceleration chamber and for generating a vacuum fault signal corresponding thereto; and an alarm coupled to said computer for receiving either said vacuum fault signal or said target fault signal and for generating said at least one alarm signal in response thereto.

20. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure; and wherein said plurality of sensors comprises:

a synthesis fault sensor for sensing an isotope and for generating a synthesis signal corresponding thereto; and an alarm for receiving said at least one alarm signal and for generating an alarm in response thereto.

21. The cyclotron monitoring system as recited in claim 20 wherein said synthesis fault sensor comprises a photo diode.

22. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure;

wherein said plurality of sensors comprises a target sensor for sensing a target and for generating a target fault signal corresponding thereto;

wherein said plurality of sensors further comprises a vacuum sensor for sensing the vacuum in said evacuated acceleration chamber and for generating a vacuum fault signal corresponding thereto and a synthesis sensor for sensing an isotope and for generating a synthesis fault signal corresponding thereto;

an alarm coupled to said computer receiving either said vacuum fault signal or said target fault signal and for generating said at least one alarm signal in response thereto.

23. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure;

wherein said plurality of sensors comprises a target sensor for sensing a target and for generating a target fault signal corresponding thereto;

wherein said plurality of sensors further comprises a vacuum sensor for sensing the vacuum in said evacuated acceleration chamber and for generating a vacuum fault signal corresponding thereto and a synthesis sensor for sensing an isotope and for generating a synthesis fault signal corresponding thereto; and wherein said computer further comprises a display for receiving said target fault signal, said vacuum fault signal and said synthesis fault signal and for generating a display corresponding thereto.

24. A cyclotron monitoring system for monitoring the operation of a cyclotron, comprising:

a plurality of sensors situated on said cyclotron for generating a plurality of signals regarding the operation of said cyclotron, said plurality of sensors capable of sensing a dry target, a vacuum failure and a synthesis failure; and a computer for receiving said plurality of signals and generating at least one alarm signal upon the occurrence of a cyclotron failure; said cyclotron failure corresponding to when said plurality of sensors senses a target failure, a vacuum failure or a dry target; and wherein said computer further comprises:

an alarm generator for receiving said plurality of signals and for evaluating said signals and determining if there is said cyclotron failure and for generating an alarm in response thereto.

25. A cyclotron monitoring system for monitoring the operation of a cyclotron, comprising:

a plurality of sensors situated on said cyclotron for generating a plurality of signals regarding the operation of said cyclotron; and a computer for receiving said plurality of signals and generating at least one alarm signal upon the occurrence of a cyclotron failure;

an alarm coupled to said computer for receiving said at least one alarm signal and for generating an alarm in response thereto;

wherein said plurality of sensors comprises a target sensor comprising a neutron detector associated with said target for monitoring a neutron flux associated with said isotope.

26. The cyclotron monitoring system as recited in claim 25 wherein said neutron detector comprises a slow neutron fission detector.

27. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said cyclotron failure is a vacuum failure.

28. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said cyclotron failure is a synthesis failure.

29. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said plurality of sensors comprises a vacuum sensor for sensing a vacuum fault in an evacuated acceleration chamber of the cyclotron and for generating a vacuum fault signal corresponding thereto.

30. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said plurality of sensors comprises a target sensor for sensing an inactive target and for generating a target fault signal corresponding thereto;

wherein said plurality of sensors further comprises a vacuum sensor for sensing a vacuum fault in an evacuated acceleration chamber of the cyclotron and for generating a vacuum fault signal corresponding thereto.

31. The cyclotron system as recited in claim 30 wherein said vacuum sensor comprises a voltage monitor for monitoring a voltage supplied to a vacuum device for evacuating an acceleration area of said cyclotron.

32. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said plurality of sensors comprises a synthesis sensor for sensing isotope fault level generated by said cyclotron and for generating a synthesis fault signal in response thereto.

33. The cyclotron system as recited in claim 32 wherein said synthesis sensor comprises a photo diode.

34. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said plurality of sensors comprises a target sensor for sensing an inactive target and for generating a target fault signal corresponding thereto;

wherein said plurality of sensors further comprises a vacuum sensor for sensing a vacuum fault in an evacuated acceleration chamber in said cyclotron and for generating a vacuum fault signal corresponding thereto and a synthesis sensor for sensing isotope fault level and for generating a synthesis fault signal corresponding thereto;

said communication means receiving said vacuum fault signal, said target fault signal, and said synthesis fault signal and generating said alarm in response thereto.

35. A cyclotron system comprising:

a cyclotron;

a plurality of sensors associated with said cyclotron;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure; and communication means for receiving said fault signal and for communicating an alarm to an operator;

wherein said plurality of sensors comprises a target sensor for sensing an inactive target and for generating a target fault signal corresponding thereto;

wherein said target sensor comprises a neutron detector associated with a target chamber for monitoring a neutron flux associated with said target.

36. The cyclotron system as recited in claim 35 wherein said neutron detector comprises a slow neutron fission detector.

37. A cyclotron system comprising:

a cyclotron;

a plurality of sensors associated with said cyclotron, said plurality of sensors capable of sensing a dry target, a vacuum failure and a synthesis failure;

a computer coupled to said plurality of sensors for receiving sensor signals from said plurality of sensors concerning the operation of said cyclotron, said computer comprising processing means for receiving said sensor signals and for generating a fault signal in response thereto upon the occurrence of a cyclotron failure, wherein said cyclotron failure corresponding to when said plurality of sensors senses a target failure, a vacuum failure or a dry target; and communication means for receiving said fault signal and for communicating an alarm to an operator;

wherein said communication means comprises a modem and at least one remote receiving unit, said modem communicating with said at least one remote receiving unit in response to said fault signal.

38. A method for monitoring a cyclotron operation comprising the steps of:

sensing a plurality of conditions associated with the cyclotron; and determining a fault condition and alarming an operator if said fault condition is encountered;

said method further comprising the steps of:

sensing a vacuum level condition by monitoring a voltage level to a vacuum device in said cyclotron to determine if the evacuator is on; and sensing an isotope level as one of said plurality of conditions;

sensing neutrons emanating from at least one target situated in the cyclotron.

39. The method as recited in claim 38 wherein said method further comprises the step of:

using a slow neutron fission detector to sense said neutrons.

40. The method as recited in claim 38 wherein said method further comprises the step of:

sensing a vacuum level condition.

41. The method as recited in claim 40 wherein said method further comprises the step of:

monitoring a voltage input to a vacuum device in said cyclotron to determine if an evacuation chamber of said cyclotron is evacuated.

42. The method as recited in claim 40 wherein said method further comprises the step of:

sensing an isotope level as one of said plurality of conditions.

43. The method as recited in claim 42 wherein said method further comprises the step of:

using a photo diode to perform said sensing step.

44. The method as recited in claim 38 wherein said method further comprises the step of:

displaying at least one of said plurality of conditions.

45. The method as recited in claim 38 wherein a plurality of conditions includes a neutron fault, said sensing step further comprising the step of:

sensing a neutron level;

sensing whether a target current level is greater than a minimum value;

indicating a neutron default if the sensed neutron level is less than a minimum neutron level and said sensed target current level is greater than a minimum current value.

46. The method as recited in claim 38 wherein a plurality of conditions is a neutron fault, said sensing step further comprising the step of:

sensing a neutron level;

sensing whether a target current level is greater than a minimum value;

indicating a current default if the sensed neutron level is greater than a minimum neutron level and said sensed target current level is less than a minimum current value.

47. A method for monitoring a cyclotron operation comprising the steps of:

sensing a plurality of conditions associated with the cyclotron;

determining a fault condition and alarming an operator if said fault condition is encountered; and wherein said method further comprises the step of:

sensing a vacuum level condition.

48. A method for monitoring a cyclotron operation comprising the steps of:

sensing a plurality of conditions associated with the cyclotron;

determining a fault condition and alarming an operator if said fault condition is encountered; and wherein said method further comprises the step of:

monitoring a voltage level to a vacuum device in said cyclotron to determine if the evacuator is on.

49. A method for monitoring a cyclotron operation comprising the steps of:

sensing a plurality of conditions associated with the cyclotron;

determining a fault condition and alarming an operator if said fault condition is encountered; and wherein said method further comprises the step of:

sensing an isotope level as one of said plurality of conditions.

50. The method as recited in claim 49 wherein said method further comprises the step of:

using a photo diode to perform said sensing step.

51. A method for making a radio chemical using a cyclotron, said method comprising the steps of:

using an evacuated acceleration chamber situated in a magnetic field;

generating a source of ions;

accelerating said ions into at least one target to produce a radioisotope; and synthesizing said radioisotope to produce said radio chemical;

sensing a plurality of conditions associated with the cyclotron; and determining a fault condition and alarming an operator if said fault condition is encountered; and wherein said method further comprises the step of:

sensing neutrons emanating from at least one target situated in the cyclotron.

52. The method as recited in claim 51 wherein said method further comprises the step of:

sensing a vacuum level condition.

53. The method as recited in claim 52 wherein said method further comprises the step of:

monitoring a voltage input to a vacuum device in said cyclotron to determine if an evacuation chamber of said cyclotron is evacuated.

54. The method as recited in claim 52 wherein said method further comprises the step of:

sensing an isotope level as one of said plurality of conditions.

55. The method as recited in claim 54 wherein said method further comprises the step of:

using a photo diode to perform said sensing step.

56. The method as recited in claim 51 wherein said method further comprises the step of:

displaying at least one of said plurality of conditions.

57. A method for making a radio chemical using a cyclotron, said method comprising the steps of:

using an evacuated acceleration chamber situated in a magnetic field;

generating a source of ions;

accelerating said ions into at least one target to produce a radioisotope;

synthesizing said radioisotope to produce said radio chemical;

sensing a plurality of conditions associated with the cyclotron; and determining a fault condition and alarming an operator if said fault condition and is encountered; and wherein said method further comprises the step of:

using a slow neutron fission detector to sense said neutrons.

58. A method for making a radio chemical using a cyclotron, said method comprising the steps of:

using an evacuated acceleration chamber situated in a magnetic field;

generating a source of ions;

accelerating said ions into at least one target to produce a radioisotope;

synthesizing said radioisotope to produce said radio chemical;

sensing a plurality of conditions associated with the cyclotron; and determining a fault condition and alarming an operator if said fault condition is encountered; and wherein said method further comprises the step of:
sensing a vacuum level condition.

59. A method for making a radio chemical using a cyclotron, said method comprising the steps of:

using an evacuated acceleration chamber situated in a magnetic field;

generating a source of ions;

accelerating said ions into at least one target to produce a radioisotope;

synthesizing said radioisotope to produce said radio chemical;

sensing a plurality of conditions associated with the cyclotron; and determining a fault condition and alarming an operator if said fault condition is encountered; and wherein said method further comprises the step of:
monitoring a voltage level to a vacuum device in said cyclotron to determine if the evacuator is on.

60. A method for making a radio chemical using a cyclotron, said method comprising the steps of:

using an evacuated acceleration chamber situated in a magnetic field;

generating a source of ions;

accelerating said ions into at least one target to produce a radioisotope;

synthesizing said radioisotope to produce said radio chemical;

sensing a plurality of conditions associated with the cyclotron; and determining a fault condition and alarming an operator if said fault condition is encountered; and wherein said method further comprises the step of:
sensing an isotope level as one of said plurality of conditions.

61. The method as recited in claim 60 wherein said method further comprises the step of:

using a photo diode to perform said sensing step.

62. A method for making a radio chemical using a cyclotron, said method comprising the steps of:

using an evacuated acceleration chamber situated in a magnetic field;

generating a source of ions;

accelerating said ions into at least one target to produce a radioisotope; and synthesizing said radioisotope to produce said radio chemical;

sensing a plurality of conditions associated with the cyclotron;

determining a fault condition and alarming an operator if said fault condition is encountered;

wherein a plurality of conditions comprises a neutron fault, said sensing step further comprising the steps of:
sensing a neutron level;
sensing whether a target current level is greater than a minimum value;
indicating a neutron default if the sensed neutron level is less than a minimum neutron level and said sensed target current level is greater than a minimum current value.

63. A method for making a radio chemical using a cyclotron, said method comprising the steps of:

using an evacuated acceleration chamber situated in a magnetic field;

generating a source of ions;

accelerating said ions into at least one target to produce a radioisotope; and synthesizing said radioisotope to produce said radio chemical;

sensing a plurality of conditions associated with the cyclotron;

determining a fault condition and alarming an operator if said fault condition is encountered;

wherein a plurality of conditions comprises a neutron fault, said sensing step further comprising the steps of:

sensing a neutron level;

sensing whether a target current level is greater than a minimum value;

indicating a current default if the sensed neutron level is greater than a minimum neutron level and said sensed target current level is less than said minimum value.

* * * * *